US005425152A

United States Patent [19]

Teron

[11] Patent Number: 5,425,152

[45] Date of Patent: Jun. 20, 1995

[54] BRIDGE CONSTRUCTION

[75] Inventor: William Teron, Ottawa, Canada

[73] Assignee: Teron International Building Technologies Ltd., Bermuda

[21] Appl. No.: 929,401

[22] Filed: Aug. 14, 1992

[51] Int. Cl.[6] ..... E01D 21/00

[52] U.S. Cl. ..... 14/24; 14/73; 14/77.1

[58] Field of Search ..... 14/2, 24, 25, 26, 73, 14/77.1, 74, 13; 264/31, 34, 35; 52/745.08, 745.13; 404/43

[56] References Cited

U.S. PATENT DOCUMENTS

| | | | |
|---|---|---|---|
| 2,110,235 | 3/1938 | Neeld | 14/73 |
| 3,027,687 | 4/1962 | Baroni | 14/73 |
| 4,809,474 | 3/1989 | Ekberg, Jr. | 52/745.13 X |
| 4,982,538 | 1/1991 | Horstketter | 52/259 |

FOREIGN PATENT DOCUMENTS

| | | | |
|---|---|---|---|
| 63453 | 2/1914 | Austria | 14/73 |
| 2074643 | of 0000 | France . | |
| 2203126 | of 0000 | Germany . | |
| 415844 | of 0000 | United Kingdom . | |
| 387097 | 2/1933 | United Kingdom | 404/43 |
| 12638 | 9/1987 | United Kingdom | 14/73 |
| 975869 | 11/1982 | U.S.S.R. | 14/1 |

OTHER PUBLICATIONS

Civil Engineering, vol. 42, No. 5, May 1972, New York, U.S. pp. 73–76, Troxell & Montgomery, "Long Span Bridge Utility, Grace at Low Cost".

*Primary Examiner*—Ramon S. Britts
*Assistant Examiner*—James A. Lisehora
*Attorney, Agent, or Firm*—Pascal & Associates

[57] ABSTRACT

A method of constructing a bridge using a two step composite construction process. In the first step, the region to be spanned is bridged with precast prestressed concrete elements that are designed as beams and complete permanent formwork to carry the dead load of the bridge, to provide a high density concrete protective shell giving a greater degree of protection against deterioration from the elements and to provide a very high quality of finish and architectural design, to provide a complete working platform for construction, and to eliminate the need for temporary scaffolding and formwork. In the second step, additional poured in place concrete is cast into the spaces created by the precast elements and serves as beams, post-tensioned to carry the live loads of the bridge. A bridge is thus created comprised of precast elongated elements supported on abutments at the sides of the spanned region, reinforced concrete beams contained by and between the adjacent elements, and a deck supported by the beams and elongated elements.

16 Claims, 7 Drawing Sheets

BRIDGE CONSTRUCTION

FIELD OF THE INVENTION

This invention relates to a method of constructing a bridge, and to a bridge so formed.

BACKGROUND TO THE INVENTION

Bridges are normally made using beams, which span a region to be covered, which are supported on abutments, and which have a flat deck spanning on top of the beams. The deck is almost always made of concrete that is poured in place into temporary formwork. While the beams have some problems, the deck is subject to many problems. These can be summarized in two main areas—the cost and difficulty of the forming and long term deterioration.

For example, bridges have been constructed using multiple parallel steel beams. However these beams suffer from corrosion induced by atmospheric pollutants, road salt, vehicle emissions, rain and bird excrement. Steel by its nature is very subject to corrosion. The ledge design of steel beams harbours dirt and pollutants that accelerate corrosion.

In order to avoid the problems of steel beams, precast prestressed concrete beams have been used. They are often referred to in the trade as "AASHTO" girders. Their configuration has a ledge design which inherently in the casting process leads to surface imperfections. The ledge also harbours dirt, pollutants, birds etc. which enter through the imperfections causing deterioration of the prestressing steel.

Both of the above described bridges are constructed with an ordinary poured in place concrete flat slab on top of the beams serving as the top deck.

Ordinary concrete decks suffer from severe long term deterioration. The deterioration is caused by water transmitted into the deck through the numerous pores and hairline cracks that are normal to an ordinary concrete deck. These pollutants reach the steel reinforcement causing it to rust and expand, which in turn causes the concrete to delaminate and eventually leads to collapse of the deck. Maintenance and repairs of concrete decks with rusted steel is difficult and costly.

The cracks in the concrete are present when the forces on the concrete are in tension and not compression. It is normal for there to be tension forces in a conventional concrete deck spanning across the tops of beams.

Prestressing concrete on the other hand is a method which compresses the concrete at very high pressures. This compresses the fine cracks and dramatically reduces the penetration of water and pollutants. To date beams have been prestressed or post tensioned, but the flat decks are not stressed and therefore are not under compression.

The construction of flat decks over open beams is difficult and costly. The formwork for these slabs is custom built, used only once and then removed, all by expensive skilled labour. The work is difficult due to the beams being very narrow, the beams being spaced many feet apart with the inherent danger to both the workers and traffic below. The formwork must be suspended between the beams to allow the deck to sit directly on the beams. The intricate dimensions mean that all formwork material is wasted and cannot be re-used. The labour to do this work is inefficient and very costly. If the bridges are in a rural area skilled labour have to be paid while travelling to the area.

The problem is worse at the outer edges of the bridge. The edge of the concrete deck is usually cantilevered and formed in complex shapes to receive guard rails, light posts etc. This edge condition is very labour intensive and costly. To avoid this costly labour as much as possible most bridges are usually utilitarian in design with very little architectural merit.

Another type of bridge is the poured in place solid concrete slab or beam. While these bridges appear simple, they are very difficult to construct because of the extensive scaffolding and formwork necessary to receive the poured in place concrete. This scaffolding and forming requires large crews of highly skilled workers, is very expensive and is very slow. These problems are compounded if traffic must continue on the road being spanned and therefore regular scaffolding cannot be used. This is normal if a bridge is being reconstructed or is located in an urban area. The disruption and cost to the community can be substantial.

Poured in place concrete bridges suffer from being very heavy and this limits their economical span. This weight can be reduced by forming voids inside or on the underside but this adds to the complexity, cost and time of construction. When voids are located inside the beam, they suffer from problems of water entering through cracks and accumulating inside the voids. The inside voids are also impossible to inspect.

Another type of bridge is the hollow box beam. This can either be cast in place or precast in pieces and installed segmentally with post-tensioning holding the pieces together in mid-air. While the poured in place hollow beams are more efficient than the solid beam with voids, the complexities and problems during construction are even greater. Segmental precast box beams are so expensive that they are only used for unusually large spans such as over wide bodies of water.

SUMMARY OF THE INVENTION

The present invention is a unique method of constructing a bridge with permanent concrete architectural beams/formwork which is less costly, faster to erect and substantially reduces the current problems of bridge deterioration.

In accordance with an embodiment of the present invention, a composite, two step, bridge construction process is used to span the region to be covered. In the first step, unique precast prestressed concrete elements are used to create the highly finished high quality protective outer shell of the bridge and provide the complete formwork and working deck for the remaining work. In the second step, the remaining regular concrete is poured into the spaces created by the precast elements and is post tensioned, all while traffic below continues uninterrupted.

The precast elements are designed to carry only the dead load of the bridge. The poured in place concrete and post tensioning is designed to carry the live load. The precast elements can therefore be lighter than conventional precast beams that must carry the entire bridge loads.

The precast prestressed concrete elements are cast to architectural concrete standards of design and finish with a very smooth finished surface (in contrast to "structural quality" concrete that is not concerned with appearance) that acts as a protective shell, dramatically reducing accumulation of dirt, fumes and chemicals, and reduces corrosion and maintenance. High strength high density concrete such as 6,000 psi. to 8,000 psi. with a very low water cement ratio is used to create these precast elements. They are cast and very carefully vibrated in very smooth steel forms to produce a concrete surface that has a polished finish, and therefore has low porosity and few imperfections that lead to deterioration of the concrete and reinforcement. The higher strength of concrete permits a higher level of prestressing and therefore greater compression of the concrete. Such quality of concrete is not possible in field cast construction using temporary wood framework. The remaining concrete of ordinary strength and quality is poured into this permanent form and is post tensioned. Since the precast elements represent e.g. only half of the bridge concrete by volume, its higher quality and strength concrete is more affordable than if used throughout the bridge.

An advantage of this composite design is that unlike traditional bridges with beams and a separate top deck, all parts of this new design, including the top deck, are in compression and therefore more resistant to penetration of water and other pollutants.

The steel molds used to cast these concrete elements are designed for multiple uses over many years, thus reducing the need for costly skilled labour having to re-construct temporary custom formwork for every bridge. This high repeat economy allows unique architectural designs of extremely fine quality to be accomplished, especially on the outer edge which is most visible to the public. This leads to bridge designs of higher civic design standards. The precast elements are cast off site on a daily turnaround basis and are erected on site within hours of arrival.

Pre-stressing or post-tensioning (tension reinforcing) cables contained in the poured in place concrete beams are shielded from corrosion by the precast elements. Temporary formwork, if used to contain and define the underside of the beam, is small, simple to install, does not require scaffolding and is recoverable after use. The deck and the poured in place beams are poured at the same time, forming an unitary structure.

In accordance with an embodiment of the invention, a method of constructing a bridge is comprised of spanning a region to be covered with spaced elongated U-shaped precast prestressed concrete elements, spanning and closing the bottoms of the regions between the prestressed elements, pouring concrete beams into the regions between the prestressed elements, and tension reinforcing the beams as structural supports for the bridge. The poured in place beams are supported by the same abutments as support the precast elements. The flat concrete deck is poured with the beams over the entire structure.

It is preferred that the elements should have horizontally extending arms which either close the bottoms of the spaces between the prestressed elements, if the U-shapes are inverted, thereby to contain the concrete of the beams or abut to close spaces between the precast elements, if the U-shaped elements are right side up and thereby contain the concrete of the beams. Alternatively the elements can support precast slabs which permanently close the bottoms of the spaces, or the elements can support temporary formwork used to close the bottoms of the spaces defining the beams.

In accordance with another embodiment, a method of constructing a bridge is comprised of spanning a region to be covered with precast prestressed elements for creating both the formwork for poured concrete beams and providing a permanent protective shell around the beams and finish surfaces to and between the beams, pouring concrete beams into the regions created by prestressed elements, and tension reinforcing the beams as structural supports for the bridge.

In accordance with another embodiment, a bridge is comprised of precast elongated elements supported by abutments at the sides of a region to be spanned, having legs mutually spaced a beam width apart, poured in-place tension reinforced beams contained between the legs of adjacent ones of the elements, and a deck supported by the beams and the elongated elements.

In accordance with another embodiment of the bridge, the elements have horizontal arms extending outwardly from the legs, closing a gap between each pair of adjacent elements, and forming a finished undersurface to the bridge.

In accordance with another embodiment, a method of constructing a bridge is comprised of spanning a region to be covered with at least one elongated precast prestressed concrete element defining at least one container for containing the concrete of a beam, the at least one element being smooth over surfaces which are spaced from surfaces facing the at least one container, pouring at least one concrete beam into the at least one container, and tension reinforcing the at least one beam as a structural support for the bridge.

In accordance with another embodiment, a method of constructing a bridge is comprised of spanning a region to be covered with abutting precast prestressed formwork elements for defining beams and a deck of the bridge, pouring concrete into the formwork to create the beams, pouring concrete over the formwork to create a deck, tension reinforcing the beams as structural supports for the bridge, and retaining the formwork as permanent surface protection for the beams and deck.

It should be understood that the formwork elements may be formed of more than one piece.

A person skilled in the art understanding this invention will recognize that the method and result is equally applicable to span regions other than roadways or the like, and can be used to construct buildings, etc. The term "bridge" in this disclosure should be construed to mean "bridging structure" in broad terms, such as bridging a floor area of a building, and the term "deck" should be construed to include building floor, etc.

BRIEF INTRODUCTION TO THE DRAWINGS

A better understanding of the invention will be obtained by reference to the detailed description below, in conjunction with the following drawings, in which:

FIG. 1A is a cross-section of a bridge in accordance with the prior art, using steel I-beams, supporting a concrete deck, FIG. 1B is a cross-section of a bridge in accordance with the prior art, using precast prestressed concrete beams, supporting a concrete deck, FIG. 1C is a cross-section of a prior art, poured in place concrete bridge (with possible voids shown in dotted lines);

FIG. 1D is a cross-sectional view of a prior art hollow box beam bridge or segmental precast post-tensioned box beam, FIG. 2 is a cross-section of a preferred embodiment of a bridge constructed in accordance with the present invention, FIG. 3 is an enlargement of a fragment of the embodiment of FIG. 2, FIG. 4 is a fragmental cross-sectional view of a variation of the embodiment illustrated in FIG. 2, FIGS. 5 and 6 illustrate two embodiments of means for providing support for the poured in place wet concrete during formation of a beam, FIGS. 7A, 7B and 7C are cross-sections of three different end portions of a bridge showing enlarged details of edge beams in accordance with the preferred embodiment of the invention, and FIGS. 8, 8A, 8B, 9, 10, 11A, 11B and 12 are cross-sections illustrating additional embodiments of the invention.

DETAILED DESCRIPTION OF THE INVENTION

Figure 1A:
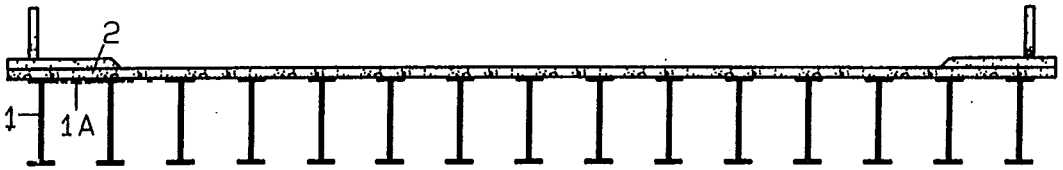
FIG. 1A PRIOR ART

FIG. 1A illustrates the cross-section of a bridge constructed with steel I-beams 1 which were commonly used to span a region to be covered by the bridge. I-beams would be spaced a distance apart, and after placing temporary formwork 1A between the beams, a concrete deck 2 would be poured.

Since the temporary formwork cannot be seated on top of the steel beam as it would prevent a structural bond between the top of the beam and the deck, the formwork must be placed between the beams and supported from below. This requires scaffolding or bracing which is difficult to install and remove, is slow, and therefore expensive.

As noted above, the steel girders attracted nesting birds and also attracted dirt and atmospheric-borne pollutants. The result was deterioration, and the requirement for frequent maintenance.

Figure 1B:
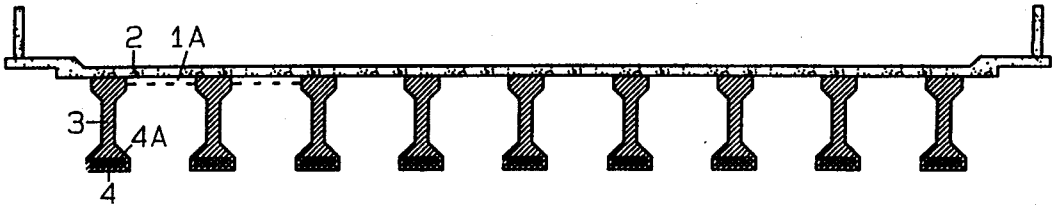
FIG. 1B PRIOR ART

FIG. 1B illustrates a bridge using prestressed precast concrete beams 3 (often referred to in the trade as AASHTO Girders) which have been used as replacements for the steel girder for new construction. The prestressing is provided by means of plural elongated cables 4.

However pits and pores in the concrete beams, especially the sloped surface which is in shadow during pouring, allow access of water pollutants and corrosive elements to the cables 4, causing them to corrode and the concrete to delaminate. This is accelerated where the cables are close to the surface of the beams, such as cables 4A. Thus corrosion of the cables must be checked very carefully which is difficult since the cables are embedded in concrete.

In both the steel girder and "AASHTO" girder designs, the beams carry all of the bridge loads and the flat deck acts structurally separate. This places many parts of the deck in tension leading to extensive fine cracks that allow water to penetrate and lead to deterioration.

Figure 1C:
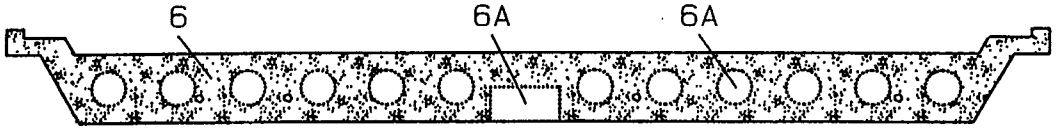
FIG. 1C PRIOR ART

FIG. 1C illustrates a cross-section of a poured in place concrete bridge 6 which contains voids such as 6A. Such a bridge is very heavy and must be supported from below during casting with extensive scaffolding and custom built temporary formwork, resulting in many of the problems described above.

Figure 1D:
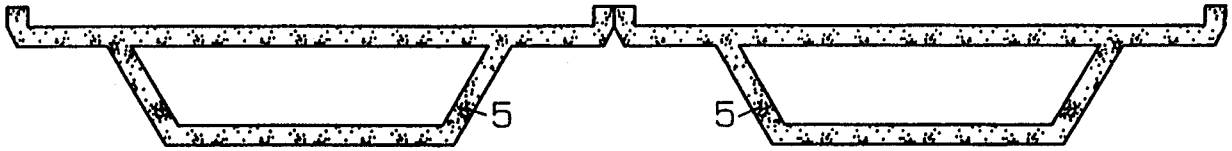
FIG. 1D PRIOR ART

FIG. 1D is an isometric view of a hollow box beam 5 sometimes used for bridges. Since the box beam is hollow, it is clear that it is costly to produce. A pair of beams 5 are shown for supporting separated traffic in two directions.

If the box beam is poured in place, it is very slow and expensive to scaffold and form, especially the hollow part. If traffic must continue below during construction, it is even more difficult and expensive to build. If the box beam is precast, it is very difficult to erect and post-tension.

Figure 2:
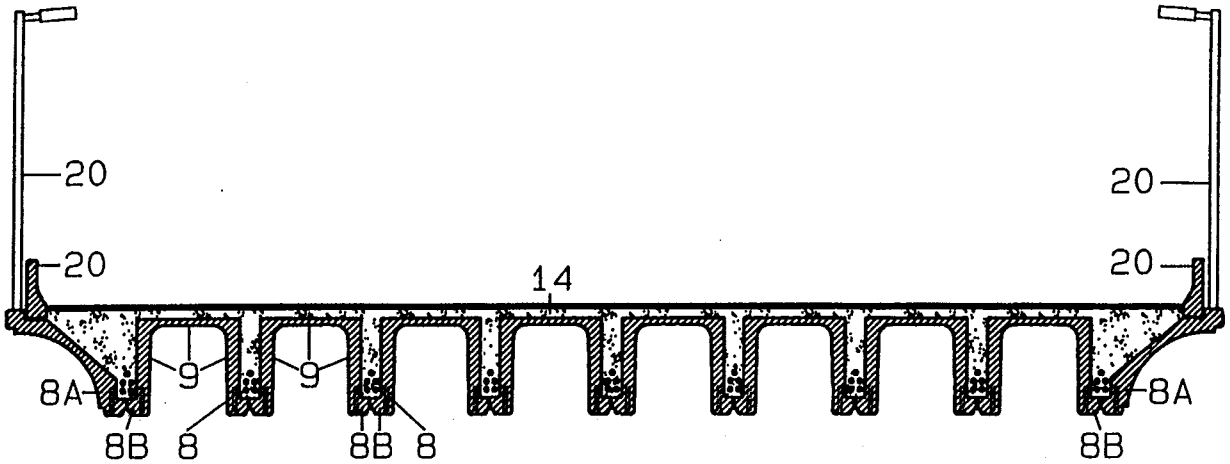

FIG. 2 illustrates the cross-section of a bridge constructed in accordance with a preferred embodiment of the present invention. In a first step, elongated, precast prestressed inverted U-shaped elements 8 having horizontal outwardly extending arms 8B are supported from abutments at the sides of the region to be covered, in the positions shown. The legs of the U-shaped elements are mutually spaced a beam width apart, the arms of adjacent elements adjoining each other to enclose the space between the legs. Edge beam-covering elongated precast prestressed elements 8A are used at the sides of the bridge, and abut the edge of the adjacent arms 8B. The precast elements are carefully vibrated and prestressed in smooth finish steel forms so that the interior undersides 9 are void-free and very smooth, preferably glossy.

Figure 3:
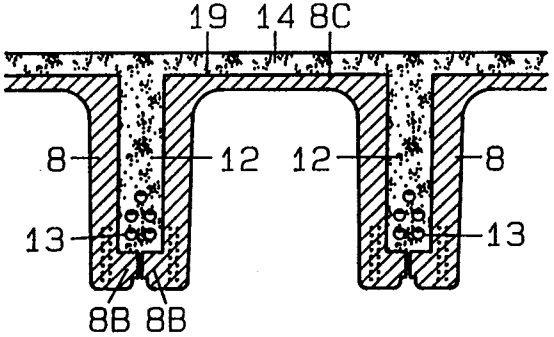

As shown in more detail in FIG. 3, concrete beams 12 are poured between the elements 8, and as shown in other drawings, between elements 8 and 8A, filling the spaces between the elements, and tension reinforcing cables 13 are laid in the concrete at the desired positions. The cables are either pre-stressed before the concrete has cured, or post-tensioned after the concrete has cured by tightening the cables 13 against the ends of the hardened beams 12 in a well known manner.

Figure 4:
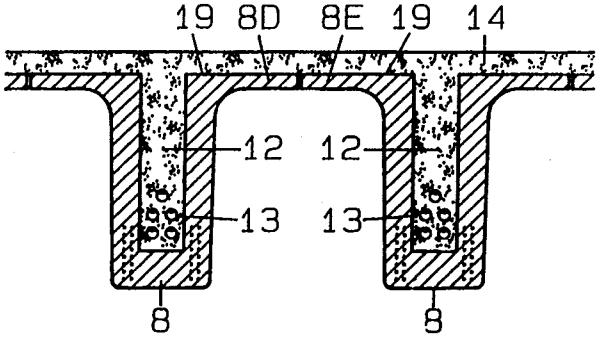

It will be recognized that the gaps between the pairs of arms 8B can be eliminated, and instead the upper arms 8C (the base of the U as shown) can be split as shown in FIG. 4. In this case the U-shapes can be considered as right side up, rather than upside down, as in FIG. 3. The elements 8 of the right side up U shapes have abutting upper arms 8D and 8E.

In each of the embodiments, at the same time as the beams are poured (before the beams have cured), a concrete deck 14 is poured over the beams and exposed upper sides of the precast elements 8. The top surface 19 of the precast can be rough or have exposed and embedded reinforcing bars to create a structural bond with the poured concrete deck. Since the deck is unitary with the beams and they act as one structural element, the deck achieves a state of compression. Waterproofing membranes, asphalt wearing surfaces, and sidewalks can be,placed on top of the concrete deck in the normal manner.

The precast elements are utilized for many purposes. They provide support for construction activities above ongoing traffic below without the need for scaffolding. This allows existing bridges to be replaced or new bridges to be built over existing road, railways, etc. without disrupting the traffic below the bridge. They provide all of the formwork required to create the poured-in place concrete beams. They provide permanent protection for the sides of the beams against corroding pollutants of the concrete and post-tensioning cables. They provide a smooth surface resulting in both a pleasing appearance to the underside of the bridge and a high-efficiency shield rejecting pollutants from entering the beam concrete. The amount of skilled labour required to build the bridge is greatly reduced, since the custom temporary formwork and complex scaffolding are now eliminated need not be built on-site. The quality of the bridge is easier to control than the prior art bridge described above because of the high quality of the steel formwork, and the cost is lower. Because the deck is in compression, delamination thereof is avoided or substantially reduced.

Once the beams have been poured and hardened, they provide the support for the live loads to be carried by the bridge. During construction of the bridge, since all construction activity is done from the top of the elements 8, traffic may continue under the bridge without the need for scaffolding and formwork. This is especially important for bridge replacement.

Figure 5:
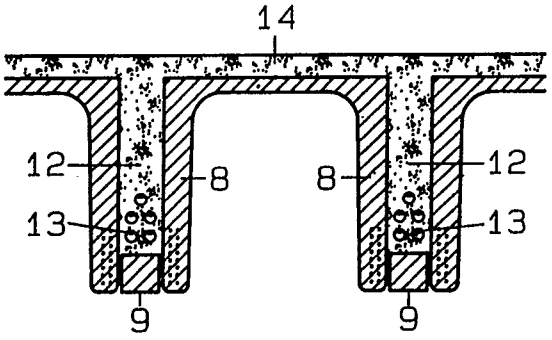

FIG. 5 illustrates another embodiment in which temporary formwork for supporting the wet concrete beams is disposed with. In this case precast concrete slabs 9 are attached to adjacent opposite legs of elements 8, e.g. by means of concrete or steel supports (not shown), and span the bottoms of the gaps between the legs of elements 8, forming permanent formwork and providing permanent protection and a smooth finish to the bottoms of the beams.

Figure 6:
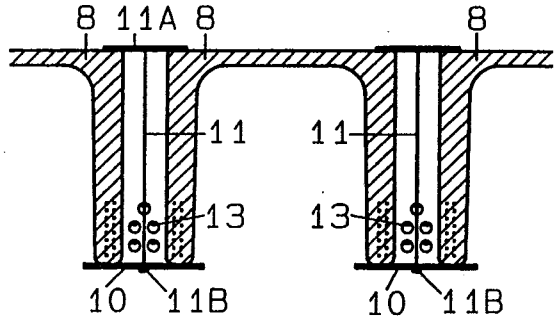

In accordance with another embodiment, in a manner e.g. as shown in FIG. 6, temporary formwork 10 is suspended by means of cables 11, supporting rods 11A and fasteners 11b from the exposed upper surfaces of pairs of elements 8 to span and close the bottoms of the regions between pairs of the precast elements 8 and 8A. The concrete beams are poured above the temporary formwork, and after the concrete hardens, the temporary formwork is removed by unfastening fasteners 11B. While the underside of the beams may be left exposed, it is preferred that they should be closed with a pollution shield, which can be held in place using the same fasteners 11B as held the formwork.

Figure 7A:
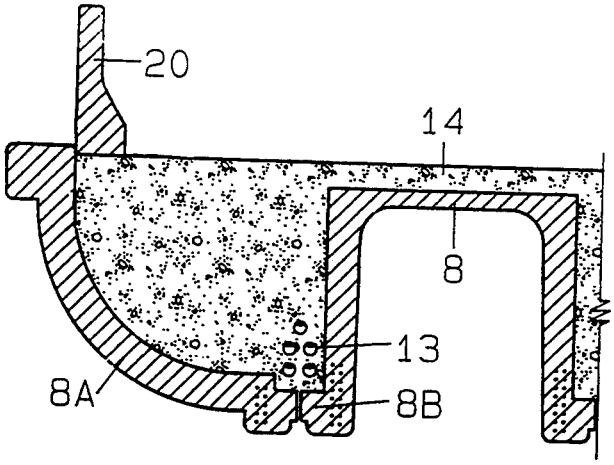
Figure 7B:
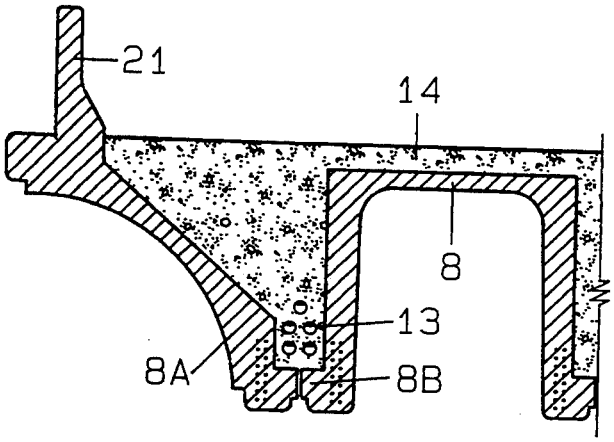
Figure 7C:
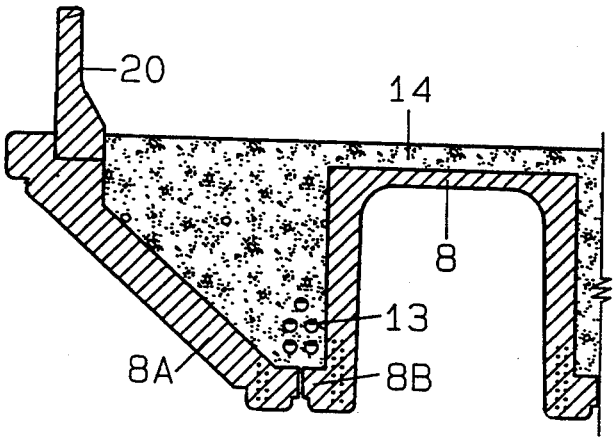

FIGS. 7A–7C illustrate in cross-section elongated precast prestressed elements 8A used as permanent formwork for the fabrication of different architecturally shaped edge beams, adjoining precast elements 8. If it is desirable to provide architecturally shaped sides to the bridge, architecturally shaped elements 8A are precast in a manner similar to elements 8, free of voids and preferably to a polished outside finish. When placed in the positions shown, supported from the bottom by the abutments at the sides of the bridge, their bottom inside edges abut the sides of arms 8B. They can be temporarily held in place by cables or by temporary supports from the abutments. Reinforcing bars can be cast into elements 8A which extend outwardly into the adjoining space where the side beam is to be poured. After pouring and hardening between elements 8A and 8, the reinforcing bars are captured by the side beams, retaining the elements 8A in place. The temporary supports can then be removed. Architectural elements 8A thus provide at the same time pleasing shapes to the sides of the bridge, protection to the side beams, and permanent formwork with adjacent elements 8 for the creation of the side beams.

The slab roadway can be poured up to the upper portions of elements 8A, allowing them to be used as curbs. The upper portions of elements 8A can be used as supports for utilities 20 such as light standards, rails, etc., as also shown in FIG. 2. Indeed, the elements 8A can be cast with an integral upwardly extending roadway edge beam 21, to create an integral traffic barrier.

Figure 8:
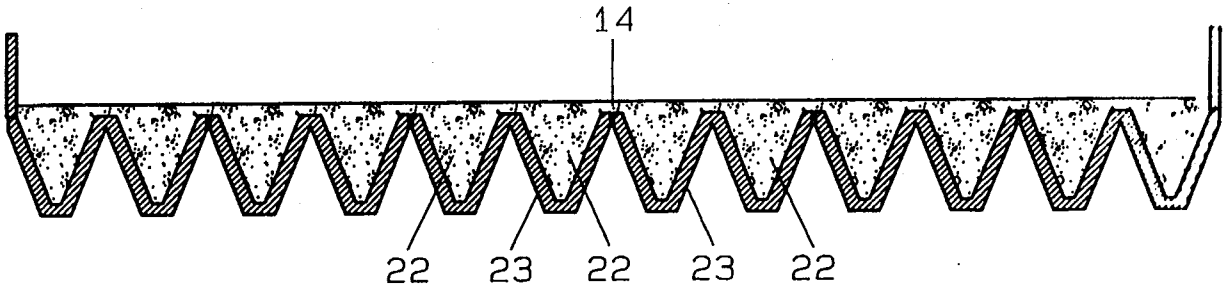
Figure 8A:
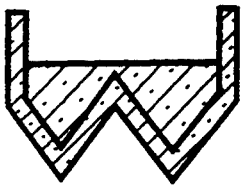
Figure 8B:
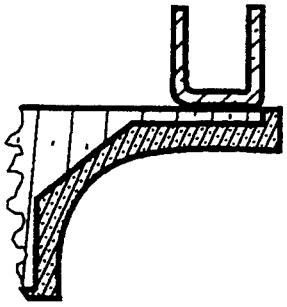

It should be noted that the same type of precast element 8 can also be used, inverted, as a precast walkway or traffic barrier as shown in FIG. 8B.

Structural forms other than U-shaped elements with or without arms may be used as the precast. For example, FIG. 8 illustrates a cross-section of a portion of a bridge using another embodiment of precast prestressed formwork. In this case the formwork 23 creates triangular cross-section beams 22. The formwork when assembled as shown have a generally zig-zag cross-section defining at least two containers, with the beams poured in the upper cavities. The formwork can be V-shaped, W-shaped (shown), etc., and are preferably abutted as shown, although in some cases it may be desirable to leave gaps between some precast elements so that gutter-shaped forms or forms for retaining utility pipes or other containers or structures such as raised rails can be inserted therebetween. This embodiment is built in a similar manner as the embodiment of FIG. 2.

Figure 9:
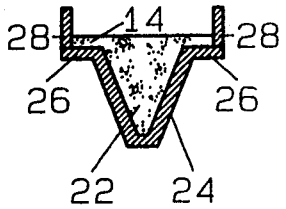

FIG. 9 illustrates an embodiment of the invention in which a precast element 24 of the type described above defines only a single beam 22. Rather than being V-shaped, the precast element could have some other shape, such as U-shaped, architecturally shaped, etc. While the deck can be poured over only the beam, in the embodiment shown the precast element 24 has outwardly extending cantilevered arms 26 which terminate in upwardly extending sides 28. The deck 14 is poured over the concrete of the beam 22 and is contained between the sides 28, thus forming an outwardly cantilevered deck. Of course several beams, rather than a single beam could be defined by the precast element. It may be desirable in many cases to use a single W-shaped precast element (forming an arch) as shown in FIG. 8A instead of a V-shaped element so that it can be supported easier by the abutments.

Figure 10:
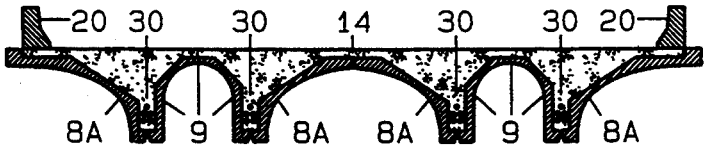

FIG. 10 illustrates the side-by-side abutment of two bridges of the type shown in FIG. 2, each utilizing a single precast element 9. A single deck 14 is poured continuously across the two bridges.

It should be noted that while this embodiment is described as being formed of abutting bridges, it may also be thought of as being formed of a single bridge, with a center span supported by beams 30. Beams 30 are created utilizing adjacent formwork 9 and 8A. The formwork 8A creating the center span form a generally U-shaped structure, with the combined formwork being segmented. It will be clear to a person understanding this specification that while the formwork has been described as being generally U-shaped or architecturally shaped elements, such elements need not be unitary, and may be segmented.

Figure 11A:
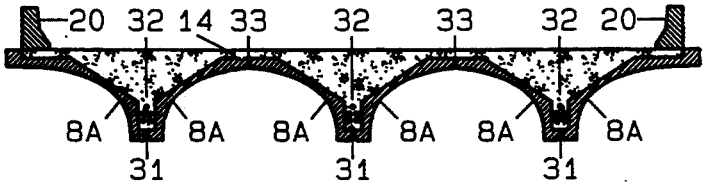

FIG. 11A illustrates an embodiment of the invention in which the precast elements are segmented, and are formed entirely of what was described above as the architecturally shaped side elements 8A. It may be seen that the elements abut at positions 31 below cast in place beams 32 and also at edges 33. As in all embodiments described herein, it is preferred that the beams and deck should be all poured in the same step.

Figure 11B:
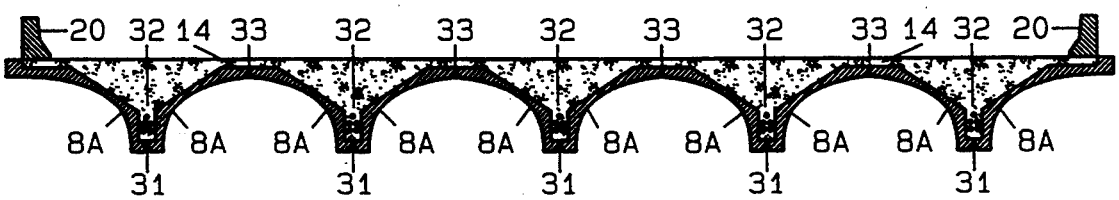

FIG. 11B illustrates the bridge of FIG. 11A but with considerably increased width, and instead of containing two complete spans and cantilevered sides, has four complete spans and cantilevered sides.

It should be noted that the beam spacing and dimensions will depend on the load to be carried. While bridges carry, besides the weight of the bridges themselves, dynamic and sometimes vibrating loads, and therefore require strong and therefore relatively thick beams, the present invention can also be used for the construction of supports for virtually static loads, such as buildings. For such structures, the embodiment of e.g. FIG. 11B would be advantageous to use since the architecturally shaped precast elements 8A form attractive vaulted ceilings. Indeed, depending on the design load of the building floor, the beam dimensions may be minimized and be barely discernible. However the finish of the precast elements avoid the requirement for adding additional finish surfaces to the ceiling.

The deck which is poured in the same step as the beams thus becomes the ceiling of one storey and the floor of the upper storey of the building. The method of construction and the resulting structure may be used for single or multi-storey buildings, under or above ground parking garages, etc.

Figure 12:
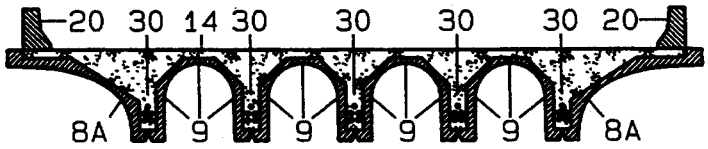

It will be recognized from the above description that the precast elements can be made in various shapes, one of the criteria being the desired architectural design when viewed from below. For example, rather than the U-shaped precast elements illustrated in FIG. 2 being formed with relatively sharp corners, they may be formed with wide radius corners, one continuous radius, or generally rounded configurations such as illustrated in FIG. 12. The shape used is limited only by the imagination of the designer, within the structural support limitations of the bridge.

While the description herein has focused mainly on the application to the invention to formation of a bridge of the type known to span a roadway, it will be recognized that it can be applied to the construction of buildings or other spanning structures. As noted earlier, therefore it is intended that the use of the term "bridge" should be construed as meaning "bridging structure" in the broadest sense, i.e., a load support spanning a region below it. Therefore in this specification the term "bridge" should be construed as widely, as including bridging structures such as building floors and roofs, arches, acquaducts, subterranean rooms and buildings, multi-storey automobile parking lots, etc. as well as road and railway bridges and causeways.

Since the precast elements described above can be factory produced off-site, this invention takes to a very high level the amount of work that can be prefabricated near or off-site, thus reducing cost. This work can be done in advance, while the abutments are being built. Erection of all precast elements can be done in one quick sequence keeping disruption of traffic to a minimum. Due to the prefabrication and multiple use of the precast elements, and elimination of scaffolding and formwork, the cost of the bridge is reduced. Construction of the bridge can be done from on top of the precast elements, making the work easier. Due to the nature of the precast elements, as described above maintenance is substantially reduced. Due to the protective action of the precast elements 8, 8A, 8B, 8C, 23 and 24, deterioration of the bridge is substantially retarded. Elements 8A also provide a decorative effect.

A person understanding this invention may now conceive of alternative structures and embodiments or variations of the above. All of those which fall within the scope of the claims appended hereto are considered to be part of the present invention.

I claim:

1. A method of constructing a bridge comprising:

(a) spanning a region to be covered with elongated U-shaped precast prestressed concrete elements having legs mutually spaced so as to define regions for containing the concrete of beams, (b) supporting said elements only at opposite ends thereof, thereby permitting traffic to pass under the elements without being obstructed, (c) pouring concrete beams into said regions, (d) reinforcing said beams as structural supports for said bridge, (e) exposed surfaces of said concrete elements having a smooth surface finished to a polished quality.

2. A method as defined in claim 1 in which exposed edges of said precast elements are rounded.

3. A method of constructing a bridge comprising:

(a) spanning a region to be covered with elongated U-shaped precast prestressed concrete elements having legs mutually spaced so as to define regions for containing the concrete of beams, (b) supporting said elements only at opposite ends thereof, thereby permitting traffic to pass under the elements without being obstructed, (c) spanning and closing the bottoms of the regions between the precast elements with permanent precast concrete formwork, the precast concrete formwork being permanently held in place from the legs of the precast elements, (c) pouring concrete beams into said regions, and (d) reinforcing said beams as structural supports for said bridge.

4. A method of constructing a bridge comprising:

(a) spanning a region to be covered with elongated U-shaped precast prestressed concrete elements having legs mutually spaced so as to define regions for containing the concrete of beams, (b) supporting opposite ends of said elements, (c) pouring concrete beams into said regions, (d) reinforcing said beams as structural supports for said bridge, (e) spanning and closing the bottoms of the regions between the precast elements with temporary formwork or permanent precast concrete formwork prior to pouring the concrete beams, and (f) said spanning and closing step being comprised of suspending the formwork by cables hung through the region between said precast elements.

5. A method of constructing a bridge comprising:

(a) spanning a region to be covered with elongated U-shaped precast prestressed concrete elements having legs mutually spaced so as to define regions for containing the concrete of beams, (b) supporting said elements only at opposite ends thereof, thereby permitting traffic to pass under the elements without being obstructed, (c) pouring concrete beams into said regions, (d) reinforcing said beams as structural supports for said bridge, (e) spanning and closing the bottoms of the regions between the precast elements with temporary formwork or permanent precast concrete formwork prior to pouring the concrete beams, and (f) all exterior exposed surfaces of the precast elements and precast formwork being finished to a polished quality.

6. A method of constructing a bridge comprising:

(a) spanning a region to be covered with V-shaped precast prestressed elements for creating and providing permanent formwork of poured concrete beams and a permanent protective layer around said beams and finished surfaces between said beams, (b) supporting said elements only at opposite ends thereof, thereby permitting traffic to pass under the elements without being obstructed, (c) pouring concrete beams into the formwork, (d) reinforcing said beams as structural supports for said bridge, (e) the spaces between the elements being closed by said elements, (f) the elements having arms extending outwardly therefrom, abutting adjacent arms of adjacent elements, the elements being elongated and container shaped for receiving and retaining beam concrete and defining shapes of the beams.

7. A method as defined in claim 6 including the further step of pouring a concrete deck over said beams and the exterior top sides of said precast elements.

8. A method of constructing a bridge comprising:

(a) spanning a region to be covered with elongated U-shaped precast prestressed concrete elements having legs mutually spaced so as to define regions for containing the concrete of beams, (b) supporting said elements only at opposite ends thereof, thereby permitting traffic to pass under the elements without being obstructed, (c) pouring concrete beams into said regions, (d) reinforcing said beams as structural supports for said bridge, (e) supporting a pair of precast prestressed architecturally shaped side beam-defining permanent formwork at edges of outwardly opposite legs of said elements to define a beam space between each formwork of said pair of formwork and an adjacent element, and pouring concrete beams into said beam spaces, (f) pouring a concrete deck over said beams and exterior top sides of said precast elements, but avoiding top edges of said pair of formwork, whereby at least one of curb, rail and utility supporting surfaces for said bridge are provided thereby.

9. A bridge comprised of precast, prestressed elongated U-shaped concrete elements, the elements each having two ends and being supported only at their ends by abutments at the sides of a spanned region during bridge construction, the elements having spaced legs, poured reinforced concrete beams contained by the legs of the elements or between the legs of adjacent ones of said elements, a deck supported by the beams and said elongated elements, precast prestressed architecturally shaped permanent formwork forming architectural sides to the bridge, extending at the sides of opposite ones of said elements and containing poured concrete beams between said opposite elements and said architecturally shaped formwork, and a traffic barrier extending upwardly from and integral with upper edges of at least one of said architecturally shaped permanent formwork.

10. A bridge comprised of precast, prestressed elongated U-shaped concrete elements, the elements each having two ends and being supported only at their ends by abutments at the sides of a spanned region during bridge construction, the elements having spaced legs, poured reinforced concrete beams contained by the legs of the elements or between the legs of adjacent ones of said elements, a deck supported by the beams and said elongated elements, precast prestressed architecturally shaped permanent formwork forming architectural sides to the bridge, extending at the sides of opposite ones of said elements and containing poured concrete beams between said opposite elements and said architecturally shaped formwork, and in which said architecturally shaped permanent formwork is abutted adjacent bottom edges of said elongated elements against arms extending from said opposite ones of said elements.

11. A bridge as defined in claim 10, in which the deck is contained between upper edges of said architecturally shaped permanent formwork.

12. A bridge as defined in claim 11, including utility structures extending upwardly from the upper edges of said architecturally shaped permanent formwork.

13. A bridge comprised of precast, prestressed elongated U-shaped concrete elements, the elements each having two ends and being supported only at their ends by abutments at the sides of a spanned region during bridge construction, the elements having spaced legs, poured reinforced concrete beams contained by the legs of the elements or between the legs of adjacent ones of said elements, a deck supported by the beams and said elongated elements, at least one of said elements being supported right side up on said deck to form a walkway, or traffic barrier.

14. A method of forming a bridge comprising at least one arch and cantilevered arms, the arch having opposite sides and a length defined between opposite ends, the cantilevered arms extending from opposite sides of the at least one arch over the length of the at least one arch over a region to be spanned, said method comprising the steps of:

supporting at least one permanent elongated precast concrete element only at the opposite ends of said at least one arch, thereby allowing traffic to pass underneath said at least one permanent elongated precast concrete element without obstruction, said at least one permanent elongated precast concrete element defining at least two containers for containing concrete of at least a pair of beams;

pouring said concrete beams and arms and a deck over said beams and arms before the concrete of the beams has cured; and retaining said at least one element in place as a protective surface of said bridge, in which the beams and deck are poured in a single step.

15. A method of forming a bridge comprising at least one arch and cantilevered arms, the arch having opposite sides and a length defined between opposite ends, the cantilevered arms extending from opposite sides of the at least one arch over the length of the at least one arch over a region to be spanned, said method comprising the steps of:

supporting at least one permanent elongated precast concrete element only at the opposite ends of said at least one arch, thereby allowing traffic to pass underneath said at least one permanent elongated precast concrete element without obstruction, said at least one permanent elongated precast concrete element defining at least two containers for containing concrete of at least a pair of beams;

pouring said concrete beams and arms and a deck over said beams and arms before the concrete of the beams has cured; and retaining said at least one element in place as a protective surface of said bridge, in which said element is formed of plural abutting architecturally shaped segments.

16. A method of forming a bridge comprising at least one arch and cantilevered arms, the arch having opposite sides and a length defined between opposite ends, the cantilevered arms extending from opposite sides of the at least one arch over the length of the at least one arch over a region to be spanned, said method comprising the steps of:

supporting at least one permanent elongated precast concrete element only at the opposite ends of said at least one arch, thereby allowing traffic to pass underneath said at least one permanent elongated precast concrete element without obstruction, said at least one permanent elongated precast concrete element defining at least two containers for containing concrete of at least a pair of beams;

pouring said concrete beams and arms and a deck over said beams and arms before the concrete of the beams has cured; and retaining said at least one element in place as a protective surface of said bridge, in which said arch is formed of a pair of identical abutting architecturally shaped elements.

* * * * *